United States Patent [19]

Hedges et al.

[11] 4,102,754

[45] Jul. 25, 1978

[54] ORE TREATMENT ELECTROLYTIC CELL

[75] Inventors: Richard A. Hedges; Maurice H. Pearl, both of Oakland, Calif.

[73] Assignee: Electrooxidation Systems, Inc., Oakland, Calif.

[21] Appl. No.: 730,011

[22] Filed: Oct. 6, 1976

[51] Int. Cl.[2] ..... C25C 7/00; C25C 7/06

[52] U.S. Cl. ..... 204/275; 204/267; 204/269

[58] Field of Search ..... 204/275, 276, 277, 273, 204/257, 263, 269, 267

[56] References Cited

U.S. PATENT DOCUMENTS

| | | | |
|---|---|---|---|
| 588,740 | 8/1897 | Becker | 204/275 |
| 3,836,443 | 9/1974 | MacGregor | 204/106 |
| 3,849,265 | 11/1974 | Scheiner | 204/86 |
| 3,969,214 | 7/1976 | Harris | 204/275 |
| 3,981,787 | 9/1976 | James et al. | 204/275 |

*Primary Examiner*—T. M. Tufariello
*Attorney, Agent, or Firm*—Flehr, Hohbach, Test, Albritton & Herbert

[57] ABSTRACT

An electrolytic cell assembly for the treatment of an ore slurry including a number of flowthrough cells formed between spaced parallel electrode plates. Slurry is fed to the bottom of the cell assembly through slots in a non-conductive manifold connected to outlet pipes from a stream splitter which is connected with a main slurry conduit.

10 Claims, 7 Drawing Figures

ORE TREATMENT ELECTROLYTIC CELL

BACKGROUND OF THE INVENTION

Electrolytic oxidation of various ores is advantageous in comparison to conventional techniques for various types of ores. For example, in one conventional process, molybdenum is recovered by a combination of multistage flotation techniques and roasting. However, such processing is relatively costly, the molybdenum recovery is extremely low, and the roasting of sulfide concentrate causes heavy atmospheric pollution. Similarly, the recovery of mercury has been performed by a pyrometallurgical process which constitutes a health hazard unless careful precautions are taken.

Because of the above problems, electrolytic oxidation has been employed for the recovery of mercury from mercury-bearing materials as set forth in Australian Pat. No. 464.246. There, an electro-oxidative cell is disclosed in which the slurry is directed from a common conduit into an open lower plenum chamber in direct communication with electrolytic cells formed in the spacing between multiple parallel upright electrode plates. The overflow from the plates is removed through ports connected in a common trough.

There are a number of problems created with respect to cell assemblies of the foregoing type. Firstly, the common inlet plenum for the electrolytic cells creates a major flowpath for stray voltage which reduces the electrical efficiency of the cells and thereby greatly increase the power required for the electrolytic process. Similarly, overflow of the cell is at a common outlet trough with a corresponding possibility of a stray voltage path.

A modification of such cell has been developed in an attempt to avoid excessive power consumption. There, slurry is supplied to the bottom of the cell flow path between spaced electrodes of the foregoing types through a series of spaced inlet pipes which extend across all cells. Such inlet pipes are connected to a common manifold conduit and include inlet spray-type openings for each cell.

There are many problems inherent in this modification. Firstly, it is very difficult to control this type of flow to obtain uniform pressure across the bottom of each cell. Uneven pressures cause variance in cell flow rates which creates unequal treatment for the slurry flowing through various portions of the cell. Additionally, spraying the slurry through such inlet holes causes a significant pressure drop with a corresponding high power consumption for operation of a pump.

Another problem with the modified cell is that the total volumetric flow through the cell is limited by the use of inlet holes in the pipes. Furthermore, the maximum particle size of the slurry is limited because it must pass through such openings. A further problem is that cells of the above type tend to accumulate particulate materials such as reaction products which tend to plug the openings. A system with small inlet openings of the above type is not adapted to back flushing to clean out residues in the cell.

A further problem with the above type of modified cell is that a common voltage path is presented across the various cells through the liquid in the pipes prior to entrance into the cells. Although such path is more efficient in power consumption than the cell which it replaced, a substantial power loss remains due to this voltage leakage.

A bipolar electrolytic cell for the electrolytic oxidation of sulfide ores to recover molybdenum is disclosed in U.S. Pat. No. 3,849,265. There, the slurry is illustrated as being directed to the bottom of a tank with upright electrodes forming separate cells. The inlet is through a common reservoir or plenum and so is subject to the type of power losses as set forth above with respect to Australian Pat. No. 464.246.

Summary of the Invention and Objects

In accordance with the present invention, an electrolytic cell is provided for the treatment of an ore slurry formed of a number of facing spaced electrode plates with slurry flowthrough passages therebetween. The cells are fed through manifolds including non-conductive walls defining slots having inlets connected to individual slurry feed pipes and outlets adjacent to the inlets of the cell flowthrough passages. The manifold includes a flow area expansion section, preferably of a truncated triangular cross-section for converting flow in a smooth transition from the slurry feed pipes to the individual electrolytic cells. Preferably, the individual feed pipes are connected through a stream splitter assembly to a main slurry source conduit. An assembly is provided for receiving the overflow slurry from the cells and directing the same to collectors located at opposite sides of the cell.

In accordance with the present method, cells of the foregoing types are employed to split the ore slurry into independent streams which are directed through independent elongate slots defined by a manifold into the electrolytic cells. The cell assembly may be periodically back-flushed for cleaning because there are no major constrictions.

It is an object of the invention to provide an apparatus having multiple electrolytic cells suitable for treatment of an ore slurry which maximizes power efficiency.

It is a particular object of the invention to reduce power losses due to stray voltages in electrolytic cells.

It is a further object of the invention to provide a cell assembly of the above type capable of treating ore slurries with relatively large particle size, of treating slurry at rapid flow rates uniformly in each cell.

It is another object of the invention to provide cells of the foregoing type in which the power requirement for pumping through the cells is minimized.

It is an additional object of the invention to minimize turbulence in the above type of cell.

Further objects and features of the present invention will be apparent from the following description taken in conjunction with the accompanying drawings.

DETAILED DESCRIPTION OF THE PREFERRED EMBODIMENTS

The electrolytic cell assembly of the present invention will be described first with reference to the overall flow system of the present invention illustrated in FIG. 1. The cell assembly finds particular use for the electrolytic oxidative treatment of a variety of ores in slurry form. In one process of this type, described in U.S. Pat. No. 3,639,222, mercury is extracted from mercury-bearing materials by electrolytic oxidation in an electrolytic salt solution. Another type of system, illustrated in U.S. Pat. No. 3,849,265, describes the recovery of molybdenum and rhenium values in sulfide-type ore in which the source is pulverized and electro-oxidized in an aqueous salt solution in an electrolytic cell. For convenience of description, this latter type of oxidation treatment will be referred to as the specific system of the present invention. However, it should be understood that other electrolytic oxidation systems may also be carried out utilizing the present apparatus.

Figure 1:
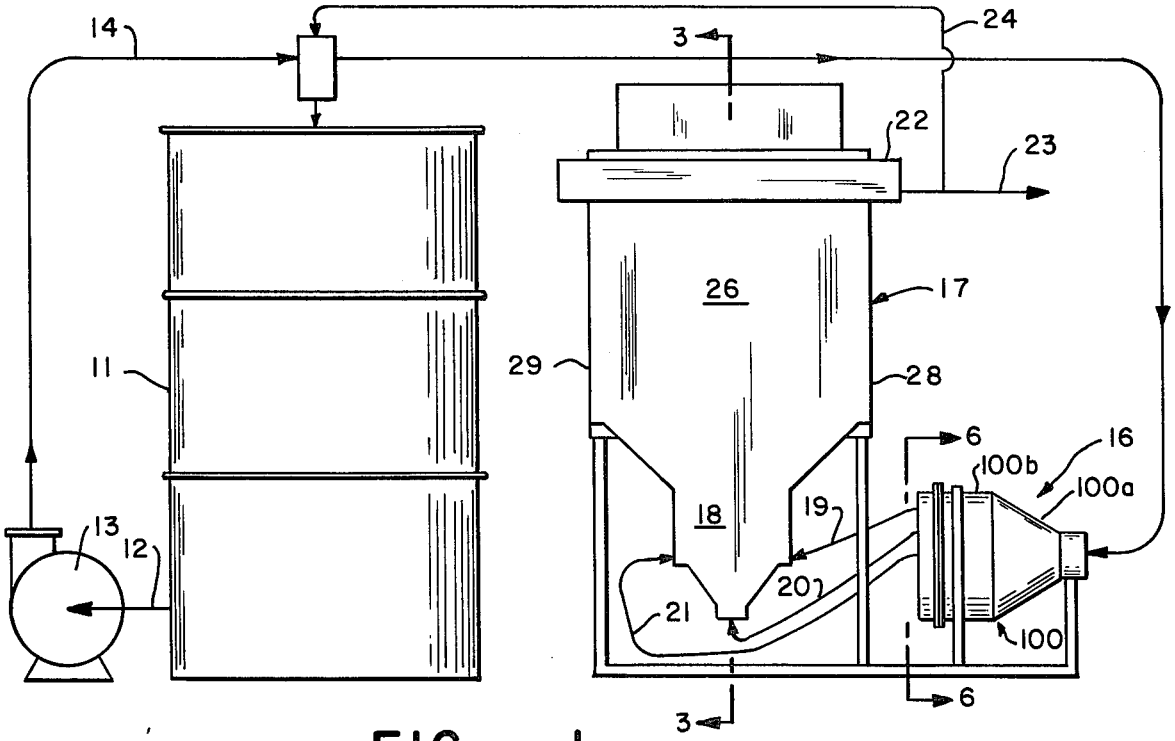
FIG. 1 is a general schematic flow-diagram of apparatus in accordance with the present invention.

Referring to FIG. 1, aqueous slurry (pulp) of a typical ore (low-grade molybdenite) is agitated in a stirred surge and agitation tank 11. Then it is transferred in line 12 to a pump 13 and directed through line 14 into the inlet side of a stream splitter 16 of a structure to be described in detail below. A number of slurry feed pipes from stream splitter 16 are directed to three different inlet portions of bipolar electrolytic cell assembly 17 including a lower manifold section 18. One series of such pipes, designated by the number 19, interconnect a series of outlet openings of the stream splitter located at the radially outward region of the stream splitter with the near side of the manifold section 18. A second series of feed pipes, designated by the number 20, interconnects an intermediate radial outlet region of stream splitter 16 with the bottom inlet openings of manifold 18. A third series of feed pipes, designated by the number 21, interconnect the central portion of the outlet of stream splitter 16 with the far side of manifold section 18. The reason for this type of pipe interconnection will be set forth below.

After passage through manifold section 18, the ore slurry flows upwardly through a plurality of electrolytic cells defined by spaced electrode plates with flowthrough passages therebetween. In such cells, mineral values in the slurry may be electrolytically oxidized. For example, the molybdenum values of a molybdenum sulfide ore is converted to the soluble salt sodium molybdate by electro-oxidation in the presence of a suitable salt such as sodium carbonate as set forth in the aforementioned U.S. Pat. No. 3,849,265. After such treatment, the slurry is collected in a cell assembly outlet means 22 to form a stream 23 which may be further processed in accordance with known techniques. A portion of stream 23 may be recycled as stream 24 to tank 11.

The electrolytically oxidized slurry is then processed by conventional techniques. For example, it may be passed to a suitable liquid-solid separator such as settling tank from which the pregnant liquid is withdrawn and passed to a suitable molybdate recovery unit such as an ion exchange unit.

Figure 2:
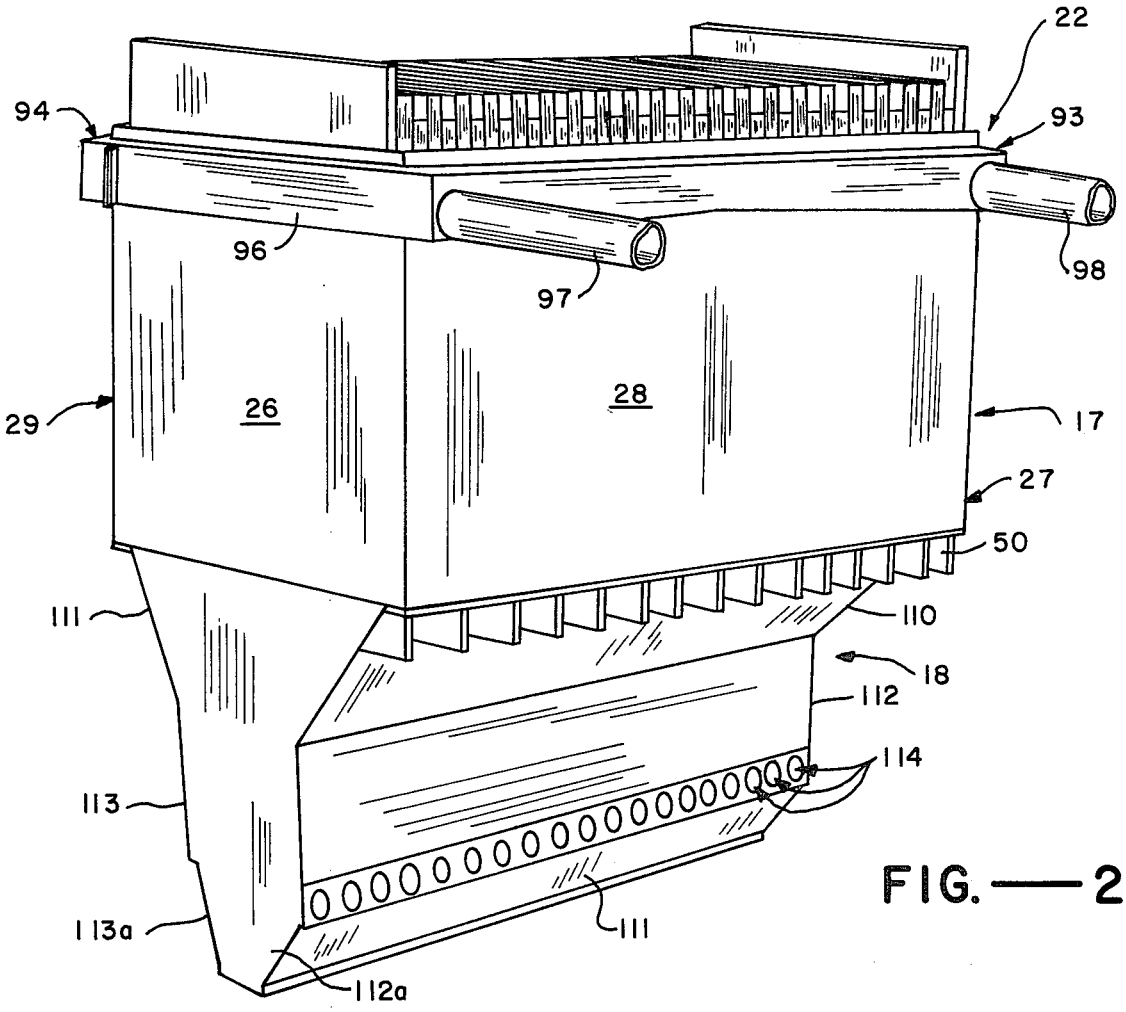
FIG. 2 is an isometric view of an electrolytic cell assembly in accordance with the present invention.
Figure 3:
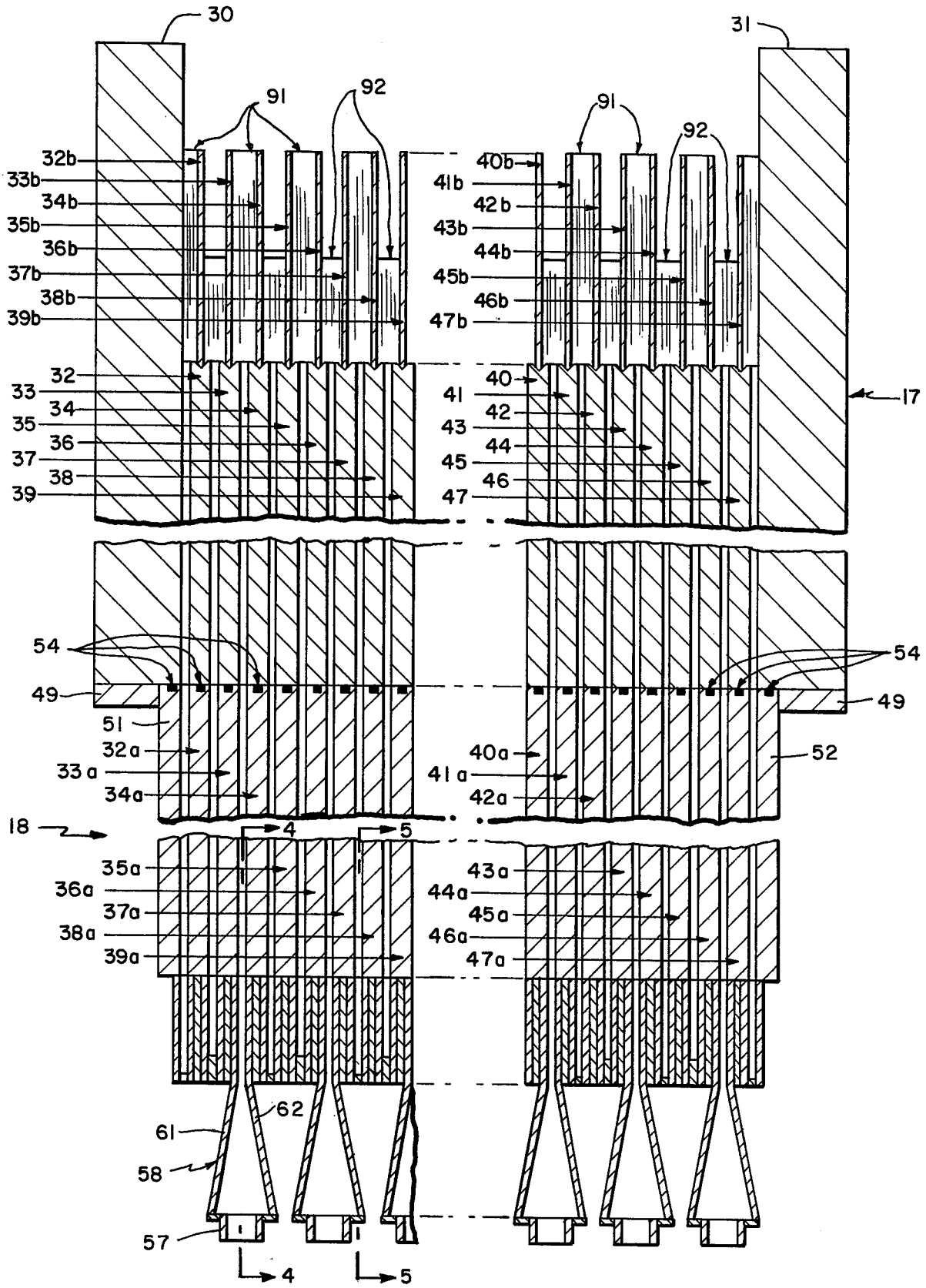
FIG. 3 is a cross-sectional view of the electrolytic cell assembly of FIG. 1 taken along the line 3—3.

The electrolytic cell assembly 17 of the present invention will now be described by reference to FIGS. 2 – 5. Non-conductive side walls 26 and 27 and front and rear walls 28 and 29, respectively, form a liquid tight box in combination with manifold section 18 to be described hereinafter. The interior of cell assembly 17 is best illustrated with respect to FIG. 3. A large anode end plate 30 and opposing end plate 31 are mounted to abut against side walls 26 and 27 and are interconnected suitably by copper bus bars to a source of direct current to form a bipolar cell. Between plates 30 and 31 are disposed parallel spaced vertical electrode plates 32 – 47, inclusive, numbered in consecutive order. The spaces between adjacent electrode plates comprise independent cell flowthrough passages. For simplicity of drawing, only a portion of the flowthrough passages are illustrated in FIG. 3.

The end of plates and central electrode plates are preferably formed of graphite. However, other electrode materials may be employed if desired for specific applications. The following description will assume the use of graphite plates.

Support of the bottom portion of the end plates and central electrode plates is preferably accomplished by resting on the top surface of manifold section 18. One purpose of the manifold section is to electrically isolate the individual cell flowthrough passages of each electrolytic cell. Thus, section 18 is preferably formed of a structurally, strong non-conductive material, suitably a plastic, such as polyvinyl chloride. Referring to FIGS. 2 and 3, manifold section 18 includes wall sections 49 and ribs 50 mounted to the top of vertical side walls 51 and 52 to support graphite end plates 30 and 31, respectively. A seal is formed at the interface between end plates 30, 31 and side walls 51, 52, suitably by providing grooves in the top of the walls in which O-rings are mounted to maintain a seal under the pressure of gravity. The central electrode plates 32 – 47 are supported in a similar manner. That is, below each plate 32 – 47 is disposed a corresponding series of spaced generally aligned adjacent non-conductive slot walls **32*a* – 47*a*, respectively. A liquid seal is formed at the interface between the slot walls and electrode plates by the provision of O-rings seated in the grooves of the walls. Adjacent slot walls, for example 32*a* and 33*a*, define slots with outlets generally adjacent to and in communication with the inlets of the cell flowthrough passages defined by corresponding electrode plates 32 and 33. In the illustrated embodiment, the slot outlets of manifold 18** are of approximately the same size as the inlet flowthrough passages.

Figure 4:
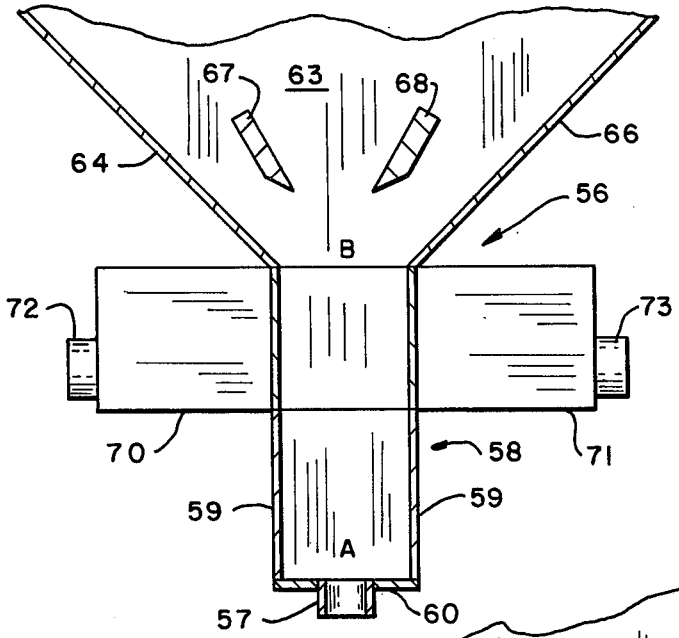
FIGS. 4 and 5 are cross-sectional views taken along the lines 4—4 and 5—5, respectively, of FIG. 3, illustrating different types of inlets for a cell assembly manifold.
Figure 5:
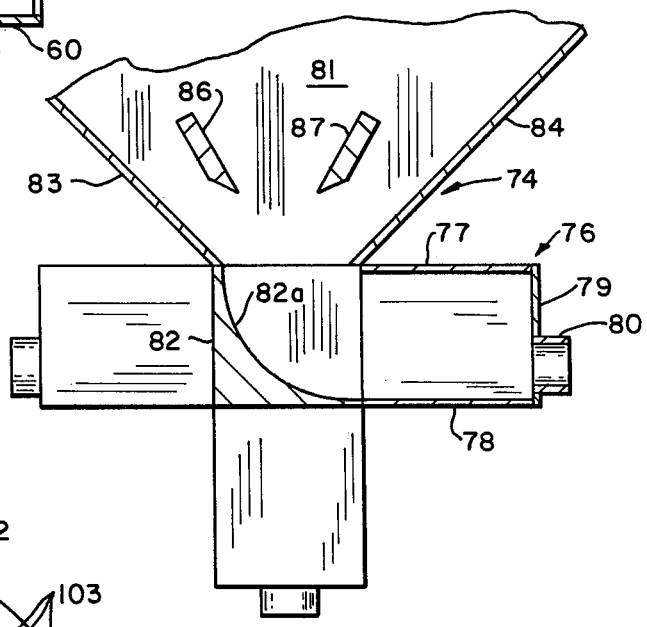

The slots of manifold section 18 include an inlet opening of a type described in detail in FIGS. 4 and 5 and interconnect with individual slurry feed pipes. The flow diameter of the slurry feed pipes is substantially larger than the flow spacing between the manifold slot walls at the inlet of the slots. The manifold includes a flow transition section defining a passage for gradual transition of flow from the feed pipes to the slots as set forth below.

Referring to FIG. 3, pipes 20 are directed into the bottom of manifold section 18 through a series of bottom flow transition sections, generally designated by the number 56. Section 53 includes a plurality of flowmodifying sections 58 terminating in cylindrical pipe adaptor nozzles 57. Section 58 also includes triangular wall 59, rectangular end wall 60 through which nozzle 57 passes, and sloping side walls 61 and 62. Triangular section 58 defines a chamber in which slurry flow from a cylindrical pipe passing through nozzle 57 is converted to conform to a rectangular slot having a width comparable to that of an electrolytic flowthrough passage and a length illustrated by the letter "A" in FIG. 4. The apex of triangular section 58 terminates at the lower end of manifold flow area expansion section 63 with a cross-section transverse to flow of progressively increasing slot length in the direction of flow, in the upward direction as illustrated. Section 63 is defined by sloping side walls 64 and 66 together forming an inverted truncated generally triangular cross-section taken along the path of flow through the slot. Walls 64 and 66 are mounted to slot walls 33*a* and 34*a* of inverted truncated triangular shape. The top of walls 64, 66, 33*a* and 34*a* define a maximum slot length at the interface of walls 33*a*, 34*a*, and end plates 33, 34, respectively. The cross-sectional of the slots at the interface is approximately the same size as the inlet of the cell flowthrough passages.

Baffle plates 67 and 68 are provided in the line of flow through section 63 to assist in uniform distribution of flowing slurry as the flow area is increased. The baffles are centrally disposed and are mounted to seal between the corresponding slot walls 33*a* and 34*a*.

Referring again to FIG. 4, side flow transition section 70 and 71 are illustrated including pipe adaptor nozzles 72 and 73. The interior of these flow transition sections will be described in more detail in FIG. 5. It is apparent that section 70 is connected to the inlet of the corresponding flow transition section from the left side while section 71 is connected from the right side, as illustrated. As is apparent from FIG. 3, the flowthrough passages would be too small to be fed from the relatively large inlet pipes from a single direction because there is insufficient space in any single plane to accomodate multiple inlets. To overcome this problem, adjacent transition sections are connected to the slot inlets at sufficiently different angles of incidence so that the connections of adjacent pipes and flow transition sections occupy different segments of a cylinder generated by a radius centered at the inlet of a slot designated by the letter "B" in FIG. 4. Thus, there is sufficient clearance for each of the flow transition sections with respect to each other. In the illustrated embodiment, the angles of incidence of adjacent flow transition sections are at approximately 90° with respect to each other. However, this may be varied depending upon the thickness of the transition sections to, say, from 30° to 100° with respect to each other. Referring again to FIG. 4, three flow transition sections are connected to respective slot inlets, in order, from a left inlet side, from vertically below the slot inlet, and from a right inlet side.

Referring to FIG. 5, the cross-section of the left side flow transition section 74 is illustrated. Section 74 includes a flow-modifying section 76 connected with a corresponding slurry feed pipe. Section 76 includes top and bottom walls 77 and 78 connected to a generally cylindrical end wall 79. A pipe adaptor nozzle 80 extends through wall 79 for connection to a corresponding slurry feed pipe. Section 76 is of generally the same configuration as section 58 of the corresponding bottom flow transition section 56. Thus, walls 77 and 78 are of generally triangular section corresponding to walls 59 of section 58 and are bounded by sloping side walls, not shown, corresponding to walls 61 and 62.

The outlet of flow-modifying section 76 is interconnected with the inlet side of flow expansion section 81 corresponding to section 63 of bottom flow transition section 56. The only structural difference between flow transition sections 56 and 74 is the provision of an interior wall 82 with a concave curved surface 82*a* for changing the direction of flow from horizontal to vertical in a smooth transition to avoid turbulence. In the illustrated embodiment, surface 82*a* is a quadrant of a circle with a lower end flush with the inner surface of wall 78.

The expansion section 81 includes sloping side walls 83 and 84. The bottom of wall 83 is mounted to the top of flow-modifying section 76 so that the inner surface of the wall is flush against surface 82*a*. The bottom end of wall 84 is mounted to the top of wall 77. Walls 83 and 84 are mounted to the sides of triangular slot defining walls 37*a* and 38*a* which terminate at their upper ends in support edges for the corresponding electrode plates 37 and 38 as described above.

Baffles 86 and 87 are provided in the slot of section 81 to provide a smooth transition of flow and a uniform slurry flow rate across the transition section. As illustrated, baffles 86 and 87 are slightly off center towards wall 83 because the maximum flow pressure and thus flow rate during the transition from a horizontal to a vertical direction will be toward that side of the section.

As illustrated in FIG. 2, the flow transition sections from the bottom and sides are formed of a unitary construction bounded by exterior side walls to form a liquid tight section through which the slurry pipe nozzles project for connection to appropriate slurry inlet pipes.

As illustrated in FIG. 3, the seal between the electrode plates and corresponding slot walls is formed by individual O-rings. The seals to front and rear walls 28 and 29, respectively, are also formed by continuing the same type of O-rings through corresponding vertically spaced slots in the walls for contact with the electrode plates. In this manner, electrode plates are sealed on three sides by O-rings to prevent leakage of liquid between adjacent flowthrough passages with a corresponding pathway for voltage leaks.

Referring to FIGS. 1 – 3, an outlet assembly generally designated by the number 22 is illustrated for receiving slurry overflow after treatment in the electrolytic cells. The outlet assembly includes a series of extension sheets 32*b* – 47*b* formed of a non-conductive material such as polyvinyl chloride mounted to extend upwardly from the corresponding electrode plates. High non-conductive barrier walls 91 are mounted across one end of alternate pairs of extension sheets, e.g., 33*b*, 34*b*, and 35*b*, 36*b*. Low barrier walls 92 are mounted an alternate sides of each high barrier wall at the same end of the extension sheets and between adjacent sheets, e.g., 32*b*, 33*b*, and 34*b*, 35*b*. At the opposite side of the extension sheets, low barrier walls, not shown, are provided across the same pair of sheets provided with high barrier walls 91, while high barrier walls, not shown, are provided across the same pair of sheets provided with low barrier walls 92 at the opposite end. In this manner, slurry in adjacent flowthrough passages flows over the top of the low barriers on alternate sides of the extension sheets.

As illustrated, the extension sheets are sealed to the top of the corresponding electrode plates in V-grooves with the bottom of the sheets being removably seated in a highly viscous sealant such as silicon rubber. The extension sheets and corresponding barrier walls are mounted in the cell assembly to form a unit of sufficient structural integrity to remain in a fixed position upon the removal of one or more electrode plates through the rear wall as described below.

Referring to FIG. 3, troughs 93 and 94 are provided at opposite ends of the electrode plates and thus extension sheets. A conduit 96 interconnects the two troughs so that liquid is removed through common outlet pipes 97 and 98 for subsequent recombination into a single outlet stream. The collection section defined by troughs 93 and 94 and conduit 96 and pipes 97 and 98 is removably mounted to the side walls of the cell assembly. Similarly, the rear wall 29 of the cell is removably mounted to the remainder of the cell as with pressure adjustable bolts. In this manner, if it is desired to remove one or more individual electrodes for replacement, this may be accomplished by removing the collection section and then the back wall.

Figure 6:
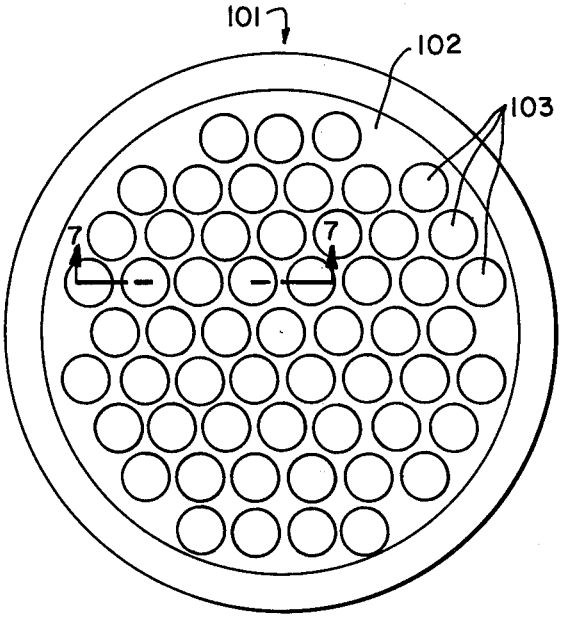
FIG. 6 is a view taken along the line 6—6 of FIG. 1 illustrating the outlet side of the stream splitter assembly.
Figure 7:
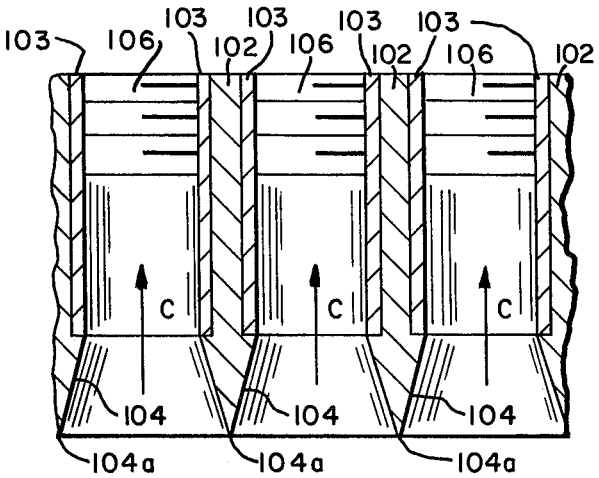
FIG. 7 is an expanded cross-sectional view of a portion of FIG. 6 taken along the line 7—7 illustrating the inlet side of the stream splitter assembly of FIG. 6.

Referring to FIGS. 3, 6 and 7, a stream splitter assembly 16 is illustrated for dividing the stream from a main slurry line 14 into a sufficient number of individual slurry feed lines for each flowthrough passage between facing electrode plates. As illustrated assembly 16 includes a stream splitter housing 100 with an inlet side connected to the main slurry feed line 14 and expanding through a frusto conical section 100*a* to contact a splitter member 101 formed of a solid plate 102 through which a desired number of individual cylindrical conduits 103 project as illustrated in FIG. 6. Splitter member 101 is disposed perpendicular to flow in the cylindrical portion 100*b* of housing 100. Slurry flows in the direction of arrow "C" in FIG. 7 through the individual passages through conduits 103. Plate 101 terminates at an upstream surface in generally V-shaped projections 104 forming points 104*a*. Projections 104 serve to direct the slurry expanding through section 100*a* from a single stream smoothly into the inlet side of conduits 103 with minimal turbulence. This lowers the pressure head requirements for pump 13 and also serves to equally distribute the slurry at fairly constant pressure to various conduits 103. The outlet of conduits 103 are fitted with suitable pipe adaptors such as threads 106 for interconnecting with conventional non-conductive slurry feed pipes, not shown, for manifold 18.

As set forth above, the slurry flowing through the radially outer conduits 103, being closest to the conical side wall of section 100*a*, is subject to maximum frictional drag and so tends to have a slightly lower head flow rate than the slurry at the center of splitter member 101. Thus, there is a gradual difference in slurry flow rate through the pipes from a maximum at the center of member 101 to a minimum at the outer periphery of the same. In an attempt to equalize this flow rate, slurry feed pipes 19 are directed from the outer periphery of conduits 103 to the nearest side of manifold 18. Similarly, slurry feed pipes 21 from the central area of member 101 travels to the most remote inlet of manifold 18. Finally, the slurry feed pipes 20 from the intermediate radial area of member 101 proceed through an intermediate distance to the bottom of manifold 18. In this manner, the differences in the pressure drop within the pipes designated 19, 20 and 21 counterbalance for the pressure drop of the slurry exiting from various areas of member 101. Thus, a substantial constant flow of slurry is directed to the various cell assemblies.

Referring to FIG. 2, manifold section 18 is illustrated in a stream-lined structurally reinforcing housing. The upper inverted frusto triangular section, corresponding to an assembly of all flow expansion sections, such as 63 and 81, is enclosed by end walls 110 and 111 formed of non-conductive rigid plastic such as polyvinyl chloride. These walls are then attached to vertical side walls 112 and 113 through which side ports 114 and ports on the opposite side, not shown, project. Walls 112 and 113 terminating in sloped wall sections 112*a* and 113*a*, respectively. Walls 112 and 113 are suitably formed by placing that portion of manifold section 18 below walls 110 and 111 in a mold which is filled with a flowable plastic which solidifies leaving only the side and bottom ports exposed. This provides additional structural strength to the overall structure.

A brief description of the operation of the above electrolytic cell is as follows. The ore material is first ground as by passing through a crusher-ball mill combination. Grinding serves to expose the mineral in the host rock for contact with the oxidizing conditions present at the anode of the system. The ground rock is then mixed in a stirred surge agitation tank 11. Assuming the unit is used for the electro-oxidation of an aqueous slurry (pulp) of a typical molybdenite ore, a slurry of the ore is charged into the tank together with aqueous brine solution as set forth in U.S. Pat. No. 3,849,265. The ore is pulverized to, say, below 35 U.S. Standard Mesh with about 65% of the solid being below 200 mesh.

The slurry is pumped from tank 11 by pump 12, suitably rated at 75 hp, having a flow rate of 1200 gpm, solids concentration of 15 – 30 wt. percent, via main slurry 14 with an inner diameter of 8 inches to the inlet side of stream splitter assembly 16. Then, the slurry expands in section 100*a* to fill cylindrical section 100*b* and is split to flow in separate streams through individual conduits 103 of splitter member 101. Conduits 103 are each mounted to slurry fred pipes (i.d. 1.30 inch) generally designated as 19, 20 and 21. Flow in pipes 19 and 21 flow in opposing sides of manifold 18 while flow in pipes 20 flows to the bottom of the same.

Referring to FIG. 4, flow through a typical bottom inlet passes through nozzles 57 and into flow-modifying sections (e.g., 56 or 74) in which each stream is converted from the generally cylindrical configuration to a slot configuration of approximately 0.26 inch and a slot length of 5 inches. Then, the slurry flows through flow area expansion section 63 to reach a maximum slot length of 4 feet. At this point, the slurry is at the same approximate size as the inlet to the respective cell slurry flowthrough passages between spaced electrode plates. Then the liquid passes upwardly between the plates and is subjected to electro-oxidation at the anodic plates. In the illustrated embodiment, the cell is of a bipolar type with a voltage of approximately 600 volts being applied from the anode end plate 30 to the cathode end plate 31. The current density is approximately 0.5 amp/sq. inch. The electrode plates between the end plates assume a potential difference approximately equal to the total voltage drop between the end plates divided by the number of cell flowthrough passages.

After electrolytic oxidation in the cell, the slurry overflows from opposite sides into independent troughs over non-conductive extension sheets and barriers as described above. In this manner, the overflowing slurry from adjacent cell flowthrough passages is isolated to prevent power loss due to stray voltage paths through the liquid. Then, the slurry is collected at streams 97 and 98 for conventional processing, such as of the type set forth in U.S. Pat. No. 3,849,265. A portion of the overflow may be recycled in line 24 to tank 11, if desired.

The above system is characterized by many advantages over that of the prior art. For example, at the inlet side of the cell assembly, the slurry streams are electrically isolated from each other from the time the slurry passes through stream splitter 16 until it passes the cell flowthrough passages. Such isolation reduces the power loss from stray voltage paths through the slurry.

Another advantage with respect to power loss is the manner of collecting overflow. Firstly, non-conductive upward extension sheets are provided with non-conductive barriers to isolate the overflow streams and to thereby minimize stray voltage paths. Furthermore, in the indicated construction, the paths overflow alternately to opposite sides to further electrically isolate such streams.

A further advantage of the above system is that there are no narrow constrictions. This permits efficient periodic backflushing for claening by reversing the flow through the system with a washing liquid. Also, it prevents undue pressure drops and also enables the use of relati-ely coarse particulate matter in the slurry to reduce the cost of expensive grinding of the particles.

What is claimed is:

1. In an electrolytic cell apparatus suitable for treatment of an ore slurry, means forming a plurality of electrolytic cells comprising a plurality of spaced electrode plates with cell slurry flowthrough passages therebetween, manifold means for feeding slurry in separate paths to the inlet side of each of said cell flowthrough passages, said manifold means including spaced adjacent non-conductive walls defining a plurality of elongated slots of generally rectangular cross-section transverse to flow, each slot including separate inlets and outlets, individual slurry feed pipes in communication with each of said slot inlets, a main slurry conduit, and stream-splitter means interconnecting said main conduit and feed pipes, the outlets of each of said slots being adajcent to and in communication with the inlets of said flowthrough passages, said manifold means including a flow area expansion section with a cross-section transverse to flow of progressively increasing slot length in the direction of flow.

2. The cell apparatus of claim 1 in which the cross-section of said slots adjacent said flowthrough passages is approximately the same size as the inlet of the flowthrough passages.

3. The cell apparatus of claim 1 in which the slots of said flow expansion sections are of truncated generally triangular cross-section taken along the path of flow through said slots.

4. The cell apparatus of claim 1 together with baffle means in the flow expansion area of said slots to promote uniform flow of slurry through the same.

5. The cell apparatus of claim 1 in which said manifold means including individual flow transition sections each interconnecting one of said feed pipes and said slot inlets.

6. The cell apparatus as in claim 5 in which the flow diameter of said slurry feed pipes is substantially larger than the flow spacing between said slot walls at the inlet of said slots, and said flow transition section defines a passage for gradual transition of flow from said pipes to said slots.

7. The cell apparatus of claim 6 in which adjacent transition sections are connected to said slot inlets at sufficiently different angles of incidence so that the connection of adjacent ones of said pipes and flow transition sections occupy different segments of a cylinder generated by a radius centered at the inlet of said slots to provide clearance for last named connections with respect to each other.

8. The cell apparatus of claim 7 in which the angles of incidence of adjacent transition sections are from approximately 30° – 100° with respect to each other.

9. The cell apparatus of claim 8 in which a series of three transitions sections are connected to respective ones of said slot inlets, in order, from one inlet side, generally vertically from the bottom, and from the other inlet side.

10. In an electrolyte cell apparatus suitable for treatment of an ore slurry, means forming a plurality of electrolytic cells comprising a plurality of spaced upright electrode plates with cell slurry flowthrough passages therebetween, slurry inlets formed in the lower region of each of said cells, outlet means formed in the upper region of said cells, said outlet means including extension sheets of non-conductive material mounted to extend upwardly from said electrode plates and also including collection means for receiving independent overflow streams from opposite sides of said extension sheets, said outlet means further including non-conductive barrier walls across alternate pairs of adjacent extension sheets, said last named sheets being mounted to anode and cathode plates, respectively, said barrier walls blocking passage of liquid between the top of said flowthrough passages and said collection means, whereby slurry in adjacent passages flows to collection means on alternate sides of said extension sheets.

* * * * *